US005993332A

United States Patent [19]

Yamagishi et al.

[11] Patent Number: 5,993,332

[45] Date of Patent: *Nov. 30, 1999

[54] SOLID GOLF BALL

[75] Inventors: Hisashi Yamagishi; Yoshinori Egashira; Hideo Watanabe; Atsuki Kasashima, all of Chichibu, Japan

[73] Assignee: Bridgestone Sports Co., Ltd., Tokyo, Japan

[ * ] Notice: This patent is subject to a terminal disclaimer.

[21] Appl. No.: 09/041,026

[22] Filed: Mar. 12, 1998

[30] Foreign Application Priority Data

Mar. 13, 1997 [JP] Japan ..... 9-079008

[51] Int. Cl.[6] ..... A63B 37/06; A63B 37/12; A63B 37/14

[52] U.S. Cl. ..... 473/377; 473/372; 473/384

[58] Field of Search ..... 473/377, 372, 473/373, 374, 351, 378, 383, 384, 385; 273/DIG. 22

[56] References Cited

U.S. PATENT DOCUMENTS 5,813,924 9/1998 Yamagishi et al. ..... 473/377
5,820,492 10/1998 Yamagishi et al. ..... 473/377

*Primary Examiner*—George J. Marlo
*Attorney, Agent, or Firm*—Sughrue, Mion, Zinn, Macpeak & Seas, PLLC

[57] ABSTRACT

A solid golf ball comprising a solid core and a cover has a multiplicity of dimples in its surface. The core undergoes a distortion of 2.8–4.0 mm under a load of 100 kg. The distortion (mm) of the core under a load of 100 kg divided by the distortion (mm) of the ball under a load of 100 kg is 1.0–1.3. The cover has a gage of 1.4–1.9 mm and a Shore D hardness of 53–60. Dimples of at least three types having different diameters are formed in the cover surface in a total number of 390–450. The diameter/depth ratio of each dimple is from 18/1 to 27/1. The volume of a dimple divided by the volume of a cylinder whose diameter and height correspond to the diameter and depth of the dimple, respectively, is 0.390–0.550. The golf ball is improved in flight distance, hitting feel and spin and will cover a distance even when hit at low head speeds.

8 Claims, 8 Drawing Sheets

SOLID GOLF BALL

BACKGROUND OF THE INVENTION

1. Field of the Invention

This invention relates to a solid golf ball featuring an increased flight distance, pleasant hitting feel and improved spin.

2. Prior Art

As compared with wound golf balls, two-piece golf balls and other solid golf balls are advantageous in gaining flying distance since they fly along the trajectory of a straight ball when hit by both a driver and an iron. This advantage is mainly attributable to their structure. Because of their configuration less receptive to spin, the solid golf balls are given a straight ball trajectory and yield a more run, resulting in an increased total distance.

In turn, the solid golf ball tends to draw a "flier" path on an iron shot since it is less receptive to spin and does not readily stop on the green. Because of such characteristics, the solid golf balls such as two-piece balls are not preferred by experienced players.

Therefore, there is a need for a solid golf ball having improved spin properties thus allowing the player to aim for the pin dead with an iron. The increased flight distance inherent to the solid golf ball should be maintained and of course, the ball should have a pleasant feel.

SUMMARY OF THE INVENTION

Therefore, an object of the present invention is to provide a solid golf ball such as a two-piece golf ball which offers an increased flight distance, pleasant hitting feel, improved spin, and improved iron control. The term iron control is the controllability of a ball on an iron shot, more specifically the ability to stop on the green.

We have found that a solid golf ball comprising a core and a cover is improved in flight distance, feel and spin by properly controlling the distortion of the core under a load of 100 kg, the distortion of the ball under a load of 100 kg, the gage and hardness of the cover, and various parameters of dimples.

The spin mechanism of a golf ball is now considered provided that only the hardness is changed while the material of the ball is unchanged. Since the club head speed and the cover material are the same, the coefficient of friction between the ball and the club face and hence, the friction force remain the same. Only the amount of distortion is different due to the difference in hardness, and the distance between the center of gravity and the ball-club contact point is different. The contact distance becomes longer with higher hardness and shorter with lower hardness. Thus harder balls are susceptible to spin.

For a structure susceptible to spin on iron shots, the spin rate can be increased by increasing the hardness of the ball. Increasing the ball hardness, however, results in a harder hitting feel. The spin rate can also be increased by making the cover softer. When the cover is made softer, however, the ball loses restitution and fails to gain an initial velocity, covering a less distance.

The inventors attempted to increase the spin rate and improve the spin properties of the ball by using a soft material, that is, a material having a Shore D hardness of 53 to 60 as the cover. The use of a cover material having a lower hardness detracts from restitution, resulting in a shorter flight distance. We have found that the objects of the invention are achieved by controlling parameters of a golf ball such that the core undergoes a distortion of 2.8 to 4.0 mm under a load of 100 kg, the distortion (mm) of the core under a load of 100 kg divided by the distortion (mm) of the ball under a load of 100 kg is from 1.0 to 1.3, the cover has a gage of 1.4 to 1.9 mm and a Shore D hardness of 53 to 60, dimples of at least three types having different diameters are formed in a total number of 390 to 450, the diameter (mm) divided by the depth (mm) of each dimple is from 18 to 27, and the ratio $V_0$ of the volume of a dimple to the volume of a cylinder whose diameter and height correspond to the diameter and depth of the dimple, respectively, is from 0.390/1 to 0.550/1. By virtue of the sophisticated combination of these parameters, despite the use of a soft material as the cover, the golf ball offers an increased flight distance, pleasant hitting feel, and improved spin allowing for iron control and quick stop on the green.

According to the invention, there is provided a solid golf ball comprising a solid core and a cover enclosing the core and having a multiplicity of dimples in its surface. The core undergoes a distortion of 2.8 to 4.0 mm under a load of 100 kg. The distortion (mm) of the core under a load of 100 kg divided by the distortion (mm) of the ball under a load of 100 kg is from 1.0 to 1.3. The cover has a gage of 1.4 to 1.9 mm and a Shore D hardness of 53 to 60. The dimples are of at least three types having different diameters, the diameter (mm) divided by the depth (mm) of each dimple is from 18 to 27, the volume of a dimple divided by the volume of a cylinder whose diameter and height correspond to the diameter and depth of the dimple, respectively, is from 0.390 to 0.550, and the total number of dimples is 390 to 450.

DESCRIPTION OF THE PREFERRED EMBODIMENTS

Figure 1:
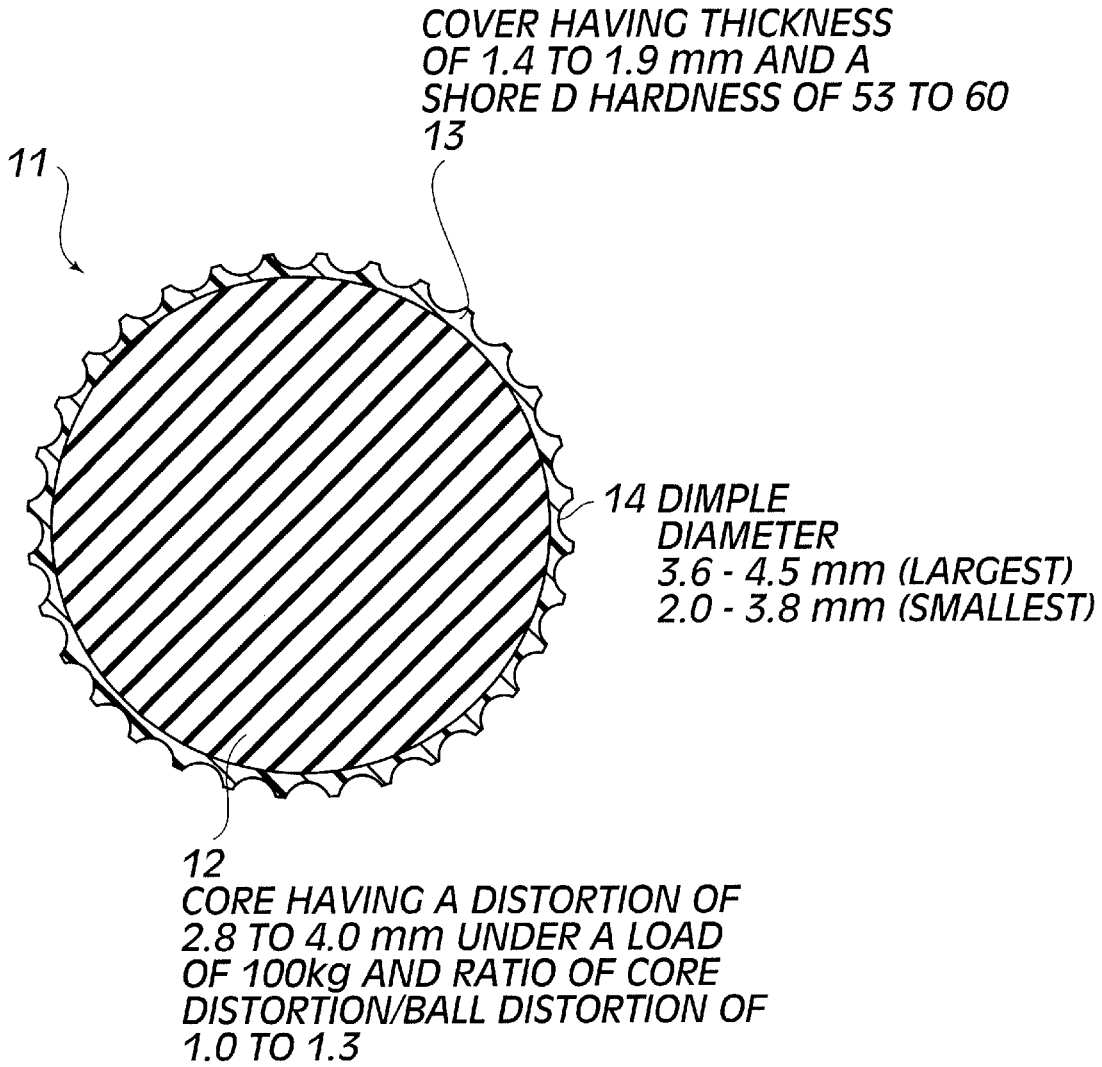
FIG. 1 is a cross-sectional view of a golf ball according to one embodiment of the invention.

Referring to FIG. 1, there is shown one exemplary golf ball according to the invention. The golf ball 11 includes a core 12 and a cover 13 which concentrically encloses the core 12 and has a multiplicity of dimples 14 in its surface.

According to the invention, the hardnesses of the core and the cover are controlled optimum.

As to the core hardness, the core undergoes a distortion of 2.8 to 4.0 mm, preferably 3.0 to 4.0 mm under a load of 100 kg. A core distortion of less than 2.8 mm detracts from the feel whereas a core distortion of more than 4.0 mm causes the ball to lose restitution, flight distance and feel.

According to the invention, the distortion A (mm) of the core under a load of 100 kg divided by the distortion B (mm) of the ball under a load of 100 kg, that is, A/B is controlled from the standpoints of flight distance, feel and spin to fall in the range from 1.0 to 1.3, preferably from 1.0 to 1.25. A A/B value of less than 1.0 detracts from feel whereas a A/B value of more than 1.3 prevents the ball from stopping on the green as desired.

The invention is applicable to two-piece solid golf balls having a single core as well as multi-core solid golf balls (three-piece or multi-piece solid golf balls) wherein the core consists of two or more layers (e.g., inner and outer layers in the case of a two-layer core). Where the core consists of two inner and outer layers, for example, the core distortion representing the core hardness designates the distortion of the entire spherical two-layer core. Stated differently, the core distortion is the distortion of the entire spherical core which is equal to the ball minus the cover.

As to the cover hardness, the cover has a Shore D hardness of 53 to 60, preferably 55 to 60. A cover with a Shore D hardness of more than 60 fails to provide satisfactory spin properties, preventing the ball from stopping on the green as desired. A cover with a Shore D hardness of less than 53 is unsatisfactory in restitution and distance.

The cover has a gage (or radial thickness) of 1.4 to 1.9 mm, preferably 1.4 to 1.8 mm. A cover thinner than 1.4 mm is less resistant to topping damage whereas a cover thicker than 1.9 mm causes the ball to lose restitution, flight distance and feel.

By controlling the cover gage within the above range, the difference in flight distance between high and low head speed shots is reduced. Differently stated, the dependency of a flight distance on head speed is reduced. Therefore, the ball of the invention is appropriate for senior and female players who swing at low head speeds of about 30 to 40 m/sec.

In the present invention, the solid core usually has a diameter of 38.85 to 39.95 mm, and the golf ball is formed to a diameter and a weight complying with the Rules of Golf, typically a diameter of 42.65 to 42.75 mm and a weight of 45.0 to 45.5 grams.

As previously mentioned, the invention is applicable to two-piece solid golf balls as well as multi-core solid golf balls such as three-piece solid golf balls while no particular limits are imposed on the materials and preparation methods of the core and the cover. They may be formed of any well-known materials insofar as the above-mentioned golf ball parameters are achieved.

The core used in the solid golf ball of the invention may be formed from a conventional well-known composition comprising a base rubber, a crosslinking agent, a co-crosslinking agent, and an inert filler while vulcanizing conditions and formulation are appropriately adjusted so as to meet the requirements of the invention.

The base rubber used herein may be natural rubber and/or synthetic rubber conventionally used in solid golf balls although 1,4-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent is typically selected from organic peroxides such as dicumyl peroxide and di-t-butylperoxide, with dicumyl peroxide being preferred. The amount of the crosslinking agent blended is preferably about 0.5 to 3 parts by weight, more preferably about 0.8 to 1.5 parts by weight per 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. The amount of the co-crosslinking agent blended is preferably about 24 to 38 parts by weight, more preferably about 28 to 34 parts by weight per 100 parts by weight of the base rubber. Examples of the inert filler include zinc oxide, barium sulfate, silica, calcium carbonate, and zinc carbonate, with zinc oxide being often used. The amount of the filler blended is preferably about 10 to 60 parts by weight per 100 parts by weight of the base rubber although the amount largely varies with the specific gravity of the core and cover, the weight of the ball, and other factors.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, at about 130 to 170° C. for a combination of dicumyl peroxide crosslinking agent with zinc acrylate co-crosslinking agent), obtaining a solid core having a diameter of 38.85 to 39.95 mm.

In the event of the two-layer core, the inside core (or layer) may be formed of a composition similar to the above-mentioned one, and the outside core (or layer) be formed of an analogous rubber material or resin material such as an ionomer resin. The outside core is preferably formed on the inside core by compression molding or injection molding. In typical examples, the inside core has a diameter of 27.0 to 38.0 mm, especially 28.0 to 36.0 mm and the outside core has a gage of 0.5 to 6.5 mm, especially 1.5 to 5.5 mm, and the overall diameter is from 38.85 to 39.95 mm.

The cover may be formed of well-known cover stocks such as ionomer resins and polyester thermoplastic elastomers, with the ionomer resins being preferred. The method of enclosing the core with the cover is not critical. Usually, the core is encased in a pair of preformed hemispherical cups, which are heat compression molded to the core, or the cover stock is injection molded around the core.

The golf ball satisfying the specific parameters can be obtained by properly selecting the types and amounts of the core and cover materials and molding conditions including vulcanizing conditions.

In the practice of the invention, there are formed in the cover surface a multiplicity of dimples of at least three types having different diameters, preferably 3 to 6 types, more preferably 3 to 5 types. The objects of the invention are not achievable with dimples of one or two types.

In one preferred embodiment, the dimples have a diameter of 2.0 to 4.5 mm, more preferably 3.0 to 4.3 mm and a depth of 0.07 to 0.28 mm, more preferably 0.09 to 0.25 mm. It is preferred from the standpoints of flight distance and spin that those dimples having the largest diameter have a diameter of 3.6 to 4.5 mm, more preferably 3.7 to 4.3 mm and a depth of 0.13 to 0.28 mm, more preferably 0.15 to 0.25 mm and those dimples having the smallest diameter have a diameter of 2.0 to 3.8 mm, more preferably 2.2 to 3.6 mm and a depth of 0.07 to 0.20 mm, more preferably 0.09 to 0.18 mm. Usually the dimples are circular in a planar shape.

According to the invention, the diameter (mm) divided by the depth (mm) of each dimple is from 18 to 27, preferably from 19 to 26, more preferably from 20 to 25. If the diameter/depth ratio is less than 18, the ball will draw a higher trajectory, covering a less distance. If the diameter/depth ratio is more than 27, the ball will draw a declining trajectory, also covering a less distance. It is * preferred from the standpoint of flight distance that those dimples having the largest diameter have a diameter/depth ratio of from 22/1 to 26/1, especially 23/1 to 25/1.

According to the invention, the volume of a dimple divided by the volume of a cylinder whose diameter and height correspond to the diameter and depth of the dimple, respectively, which value is designated $V_0$, is from 0.390 to 0.550, preferably from 0.395 to 0.545, more preferably from 0.400 to 0.540. With $V_0<0.390$, the ball will draw a declining trajectory, covering a less distance. With $V_0>0.550$, the ball will draw a rather skying trajectory.

Figure 2:
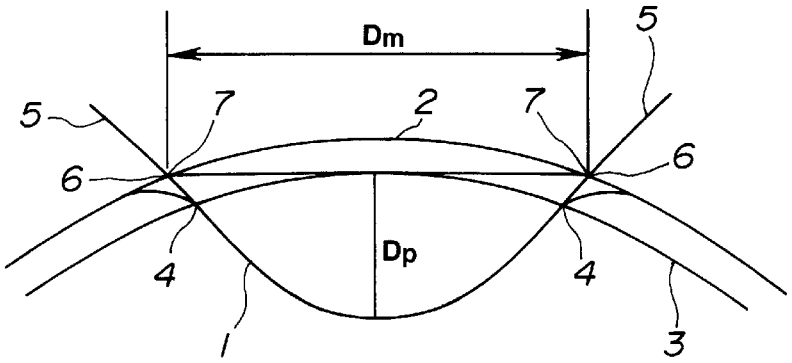
FIG. 2 is a schematic cross-sectional view of a dimple illustrating how to calculate the volume of a dimple and the volume of a cylinder.
Figure 3:
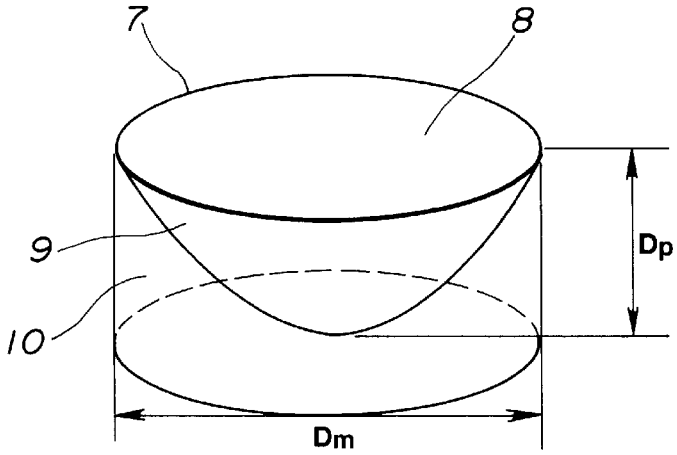
FIG. 3 is a perspective view of the same dimple.
Figure 4:
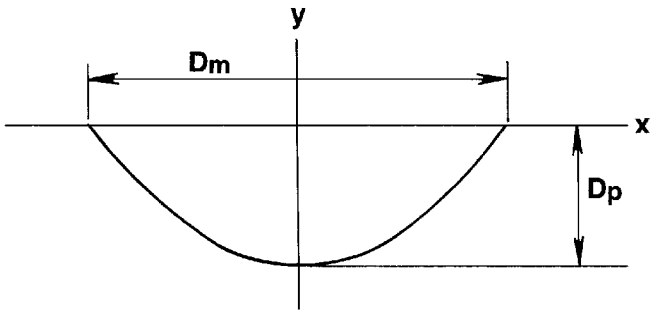
FIG. 4 is a cross-sectional view of the same dimple.
Figure 5:
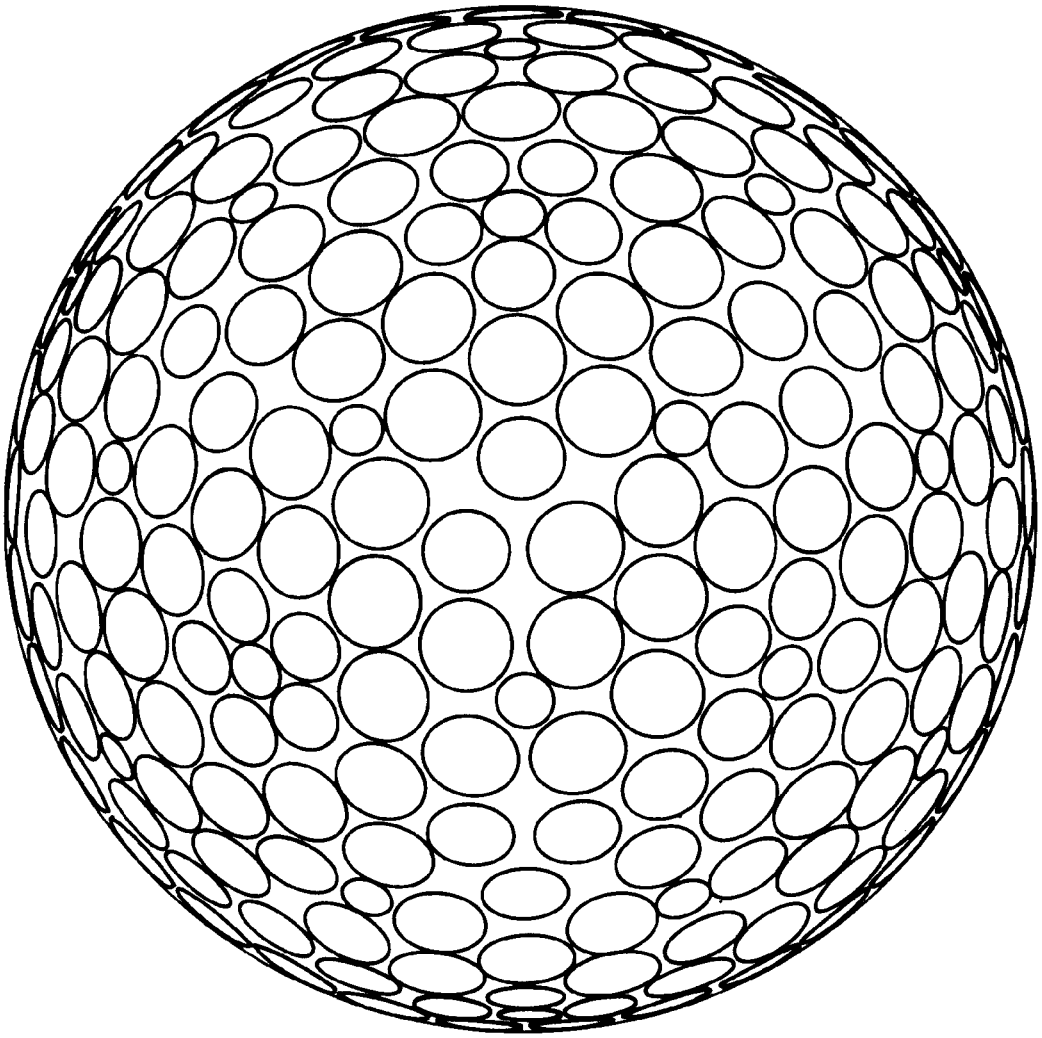
FIG. 5 is a plan view of a golf ball showing the arrangement of dimples according to one embodiment of the invention.
Figure 6:
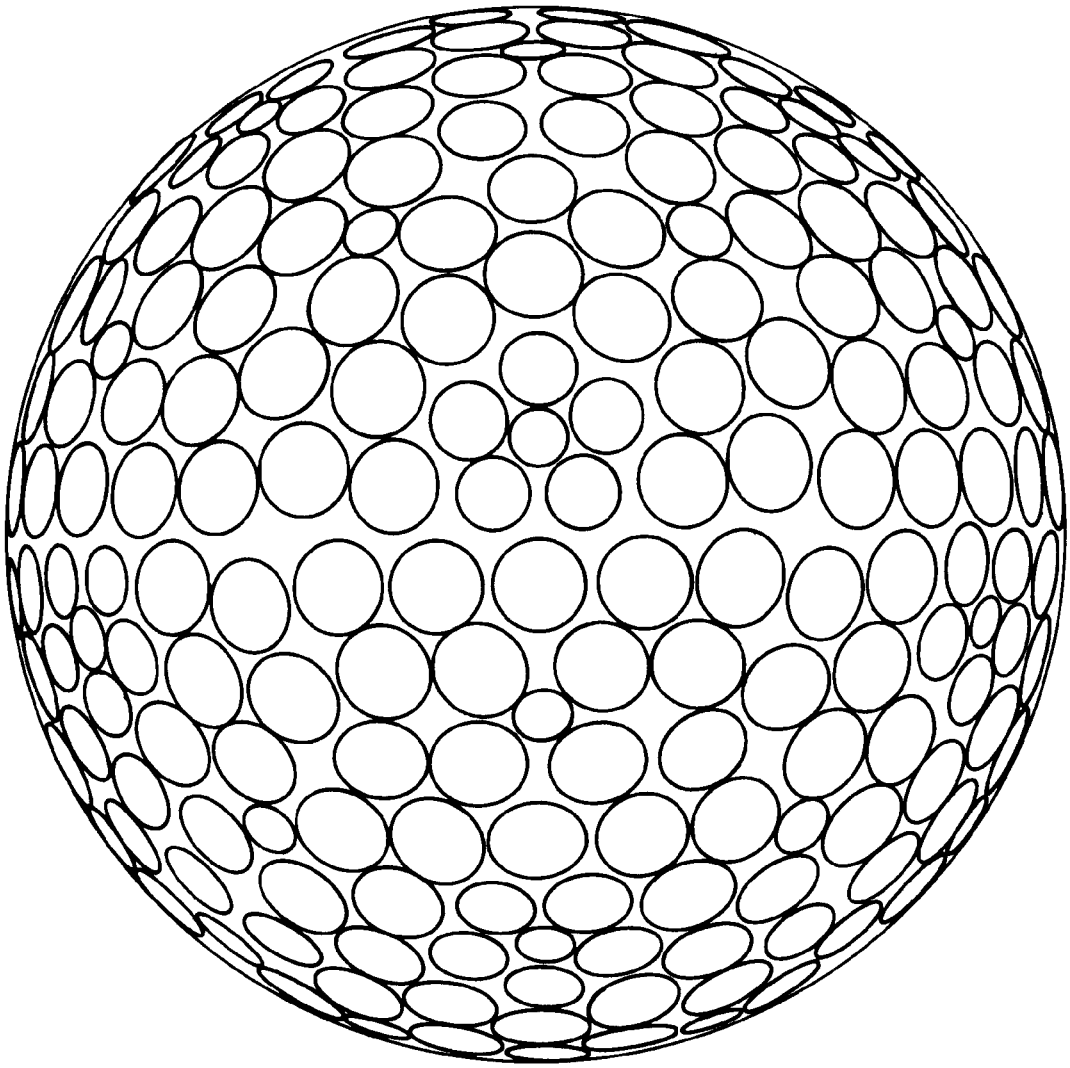
FIG. 6 is an elevational view of the golf ball of FIG. 5.
Figure 7:
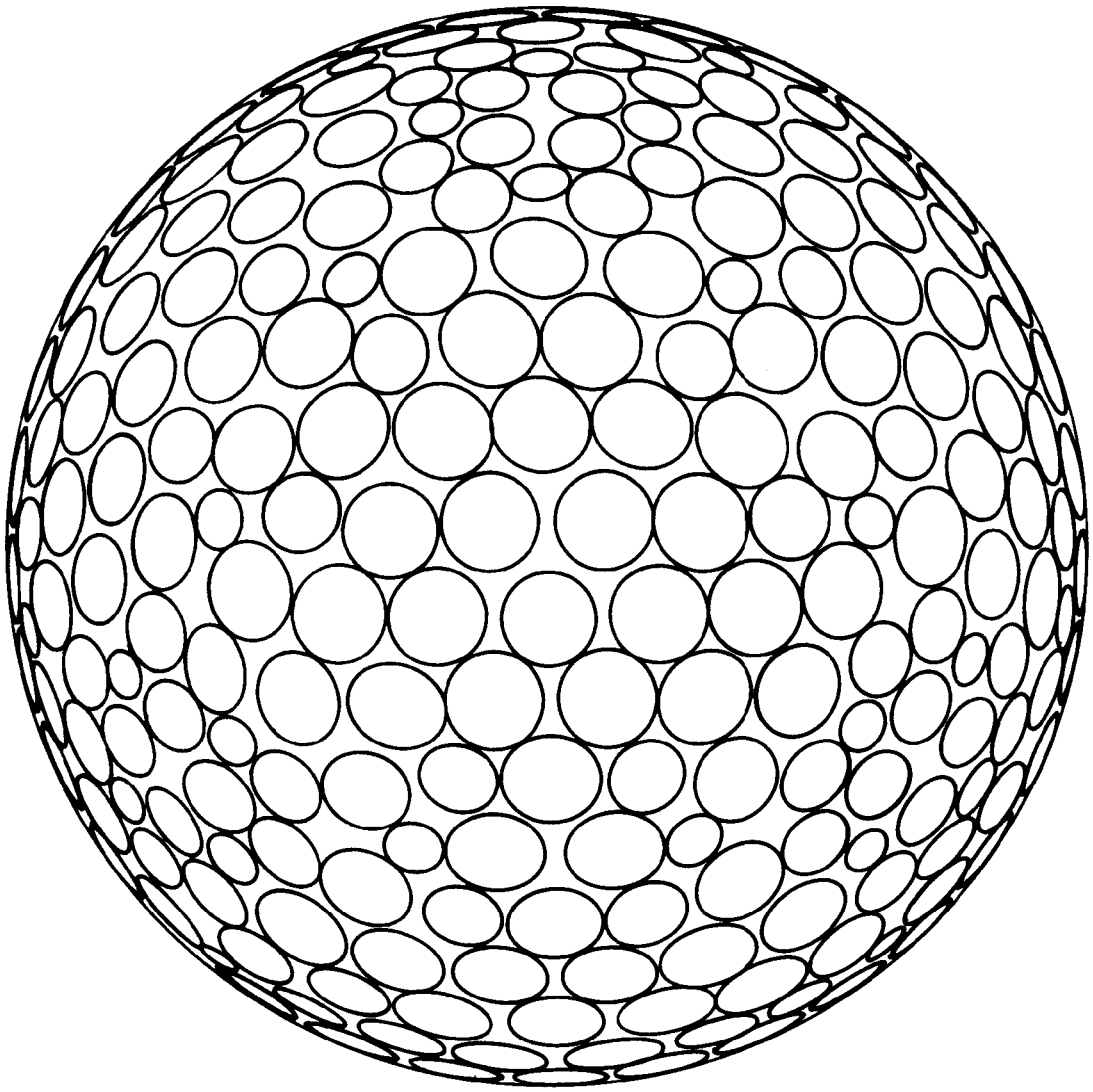
FIG. 7 is a plan view of a golf ball showing the arrangement of dimples according to another embodiment of the invention.
Figure 8:
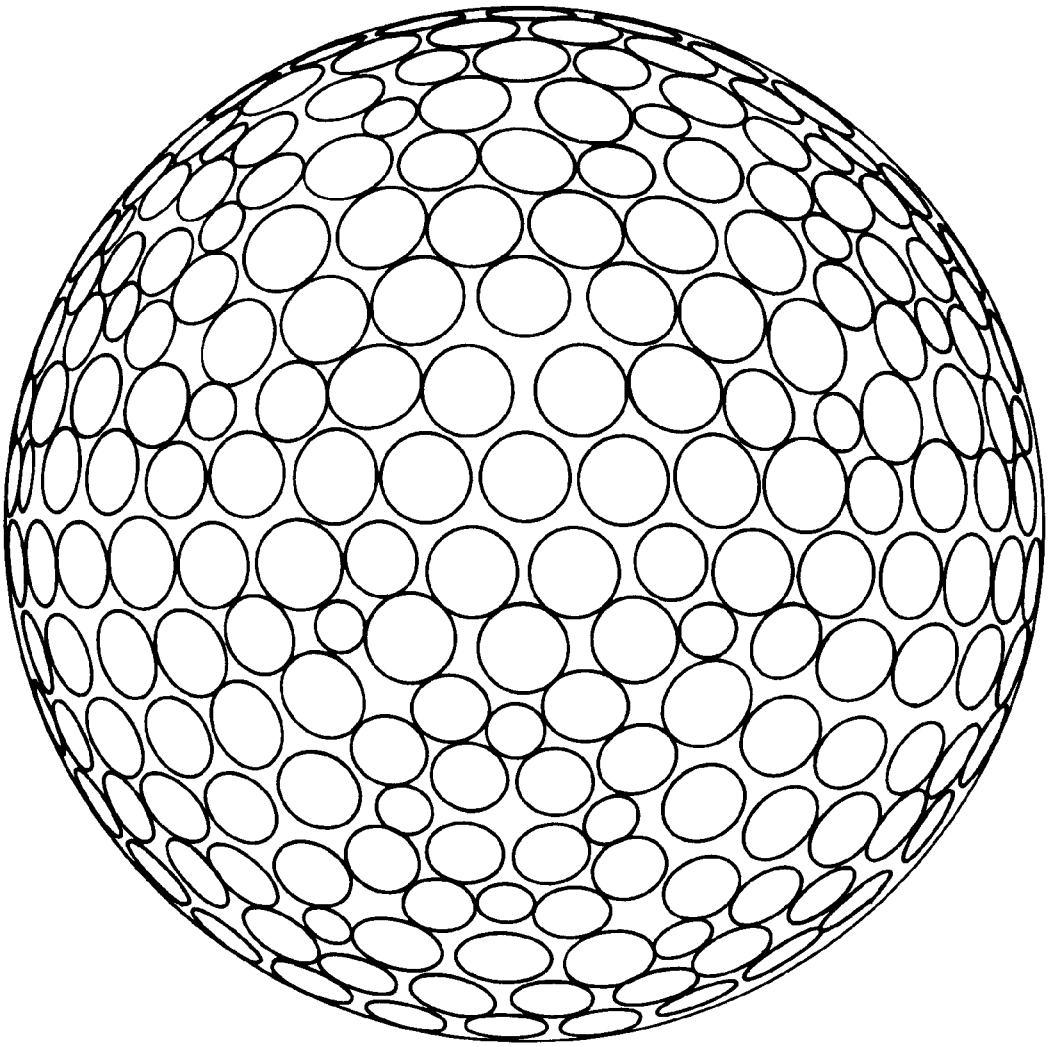
FIG. 8 is an elevational view of the golf ball of FIG. 7.
Figure 9:
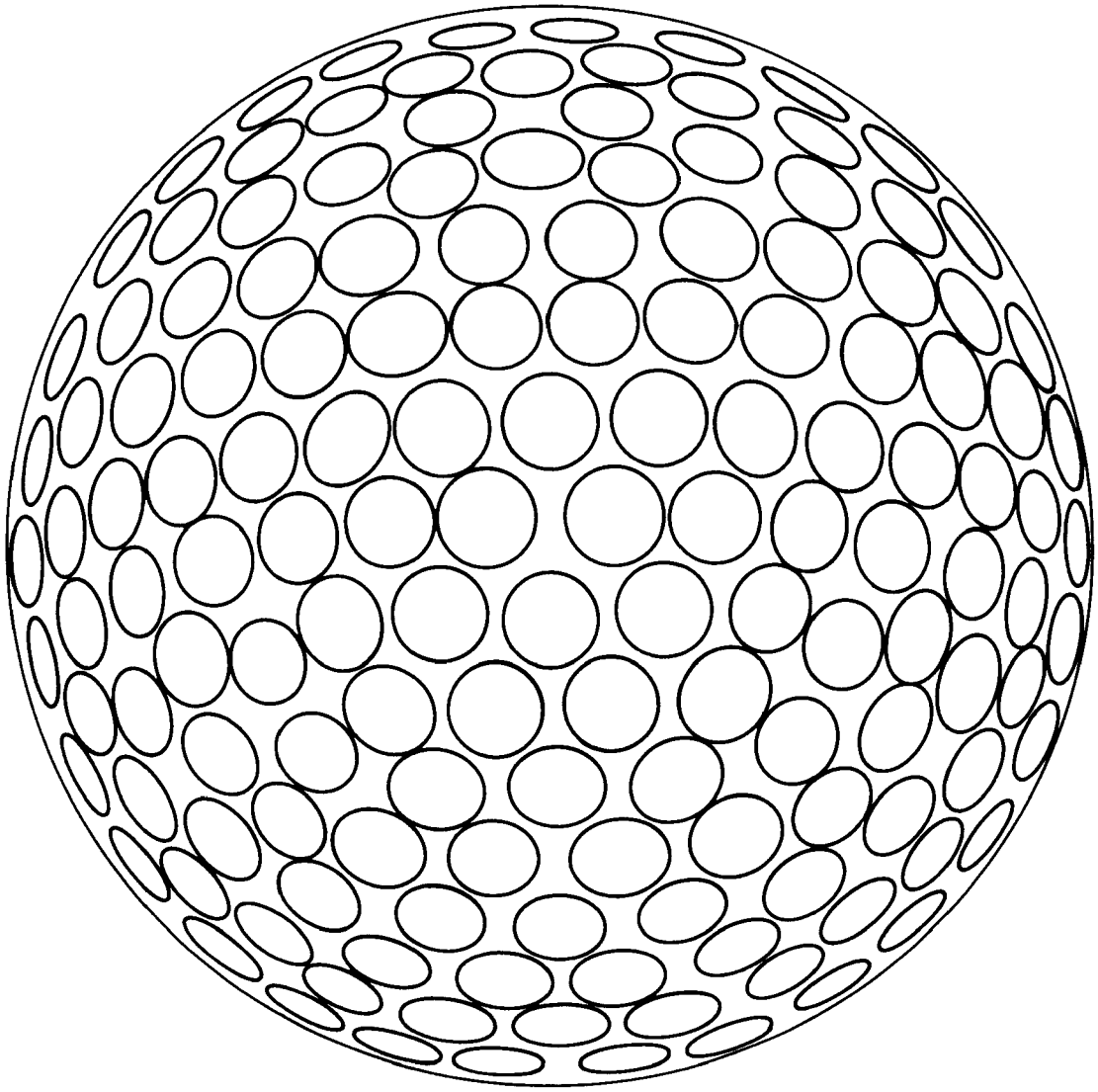
FIG. 9 is a plan view of a golf ball showing the arrangement of dimples according to a further embodiment of the invention.
Figure 10:
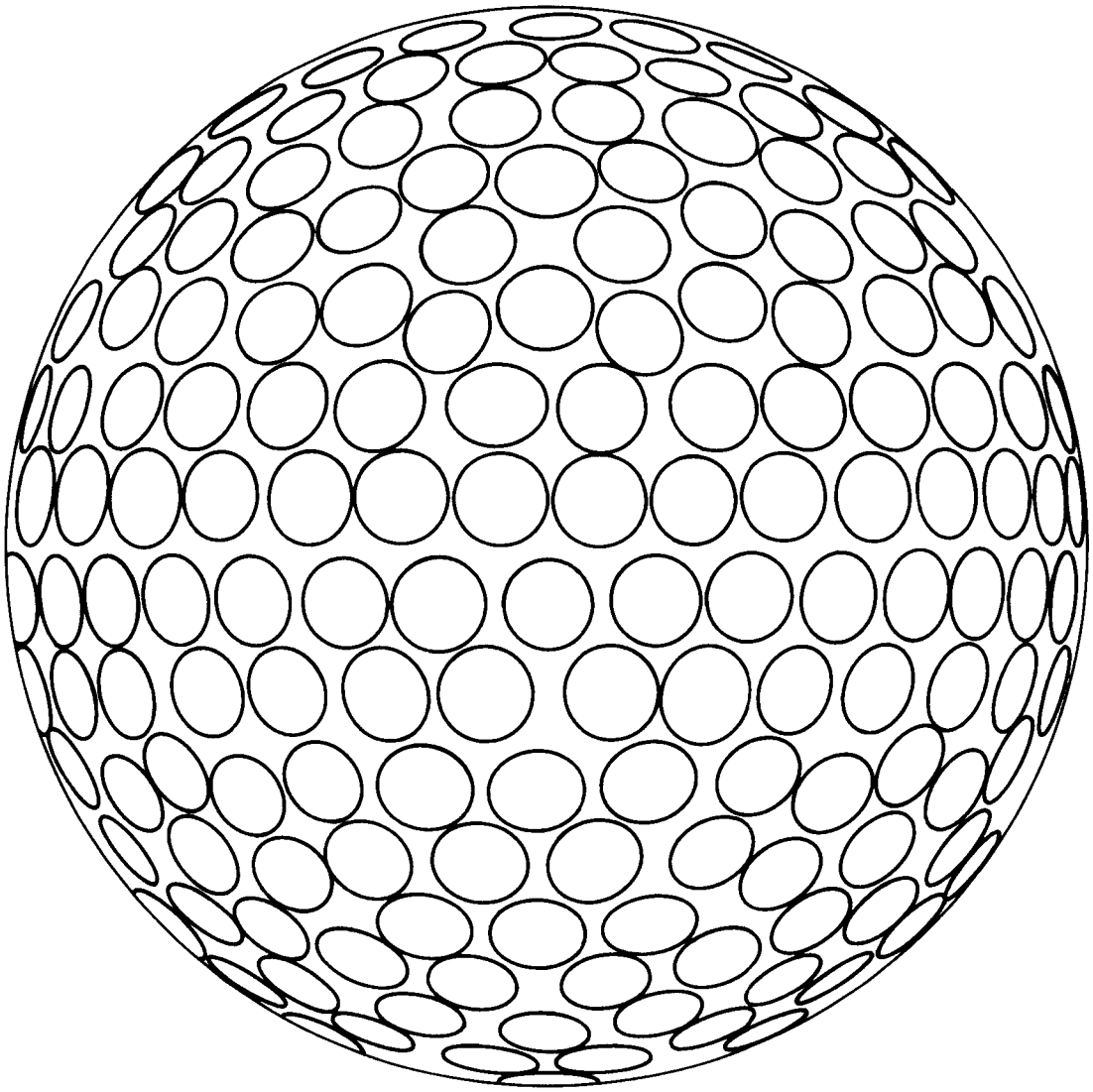
FIG. 10 is an elevational view of the golf ball of FIG. 9.

Referring to FIGS. 2 to 4, a determine $V_0$ is depicted. For simplicity's sake, it is assumed that the planar shape of a dimple is circular. As shown in FIG. 2, a phantom sphere 2 having the ball diameter and another phantom sphere 3 having a diameter smaller by 0.16 mm than the ball diameter are drawn in conjunction with a dimple 1. The circumference of the other sphere 3 intersects with the dimple 1 at a point 4. A tangent 5 at intersection 4 intersects with the phantom sphere 2 at a point 6 while a series of intersections 6 define a dimple edge 7. The dimple edge 7 circumscribes a plane 8 (having a diameter Dm). Then as shown in FIGS. 3 and 4, the dimple space 9 located below the plane 8 has a volume Vp. A cylinder 10 whose bottom is the plane 8 and whose height is the maximum depth Dp of the dimple from the bottom or circular plane 8 has a volume Vq. The ratio $V_0$ of the dimple space volume Vp to the cylinder volume Vq is calculated.

$$Vp = \int_0^{\frac{Dm}{2}} 2\pi xy\,dx$$

$$Vq = \frac{\pi Dm^2 Dp}{4}$$

$$V_0 = \frac{Vp}{Vq}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

The total number of dimples is 390 to 450, especially 392 to 440. It is preferred from the standpoint of flight distance that those dimples having the largest diameter account for at least 10%, more preferably 10 to 50%, further preferably 15 to 40%, most preferably 17 to 30% of the total dimple number, while those dimples having the smallest diameter account for 5 to 40%, especially 10 to 35% and the remaining dimples account for 5 to 80%, especially 10 to 70% of the total dimple number.

The dimples may be arranged in a conventional manner.

There has been described a solid golf ball which is improved in flight distance, hitting feel and spin and will cover a distance even when hit at low head speeds.

EXAMPLE

Examples of the present invention are given below by way of illustration and not by way of limitation. All parts are by weight.

Examples 1–5 & Comparative Examples 1–5

Cores having the hardness or distortion (mm) under a load of 100 kg shown in Table 1 were molded by vulcanizing in a mold rubber compositions comprising varying amounts of cis-1,4-polybutadiene rubber, zinc acrylate, zinc oxide, and dicumyl peroxide. Covers having the Shore D hardness shown in Table 2 were formed on the cores by using mixtures of ionomer resins in varying ratios. There were obtained large size two-piece golf balls having the hardness or distortion (mm) under a load of 100 kg shown in Table 3.

Specifically, the basic composition for the core is shown below.

| | |
|---|---|
| Cis-1,4-polybutadiene (BR01) | 100 parts |
| Zinc acrylate | Table 1 |
| Zinc oxide | 10 parts |
| Barium sulfate | Table 1 |
| Antioxidant | 0.2 part |
| Dicumyl peroxide | 0.9 part |

Cores which were different in distortion and specific gravity were obtained.

The covers having the hardness shown in Table 2 were formed by using various ionomer resins and blending them in the ratio shown in Table 2.

In the cover surface, dimples having the parameters shown in Table 3 were formed. The arrangements of dimples are as shown in Table 3 and FIGS. 5 to 10.

TABLE 1

| | Core distortion (mm) | Cover distortion (mm) | Zinc acrylate (pbw) | Barium sulfate (pbw) |
|---|---|---|---|---|
| Example 1 | 2.95 | 1.50 | 30 | 8.7 |
| Example 2 | 3.30 | 1.50 | 28 | 9.6 |
| Example 3 | 3.60 | 1.80 | 26 | 12 |
| Example 4 | 3.90 | 1.50 | 22 | 12.5 |
| Example 5 | 3.95 | 1.90 | 23 | 13.5 |
| Comparative Example 1 | 2.60 | 2.00 | 33 | 9.7 |
| Comparative Example 2 | 3.00 | 1.40 | 30 | 8.2 |
| Comparative Example 3 | 2.90 | 2.40 | 31 | 13.9 |
| Comparative Example 4 | 3.00 | 1.90 | 30 | 10.9 |
| Comparative Example 5 | 4.00 | 1.80 | 22 | 13.6 |

TABLE 2

| | | Cover | | | |
|---|---|---|---|---|---|
| | | I | II | III | IV |
| Cover resin mixture (pbw) | Himilan 1650 | 40 | — | — | — |
| | Surlyn 8120 | 60 | — | — | — |
| | Himilan 1557 | — | 50 | — | — |
| | Himilan 1601 | — | 50 | 50 | — |
| | Himilan 1705 | — | — | 50 | — |
| | Himilan 1605 | — | — | — | 50 |
| | Himilan 1706 | — | — | — | 50 |
| Cover hardness (Shore D) | | 56 | 57 | 60 | 65 |

Himilan and Surlyn are the trade names of ionomer resins commercially available from Mitsui-duPont Polychemical K.K. and E. I. duPont, respectively.

TABLE 3

| Dimple arrangement | Diameter (mm) | Depth (mm) | $V_0$ | Dimple number | Diameter /depth | |
|---|---|---|---|---|---|---|
| | Dimple parameters | | | | | |
| A | 3.950 | 0.174 | 0.485 | 276 | 22.7 | FIGS. |
| | 3.610 | 0.153 | 0.492 | 24 | 23.6 | 5 & 6 |
| | 3.220 | 0.142 | 0.485 | 60 | 22.7 | |
| | 2.365 | 0.112 | 0.492 | 36 | 21.1 | |
| B | 3.810 | 0.172 | 0.510 | 264 | 22.2 | FIGS. |
| | 3.190 | 0.144 | 0.510 | 120 | 22.2 | 7 & 8 |
| | 2.340 | 0.105 | 0.510 | 48 | 22.3 | |
| C | 3.950 | 0.200 | 0.380 | 240 | 19.8 | FIGS. |
| | 3.100 | 0.200 | 0.380 | 120 | 15.5 | 9 & 10 |

The golf balls were examined for flight distance, green stoppage, and hitting feel. The results are shown in Table 4.

Flight distance

The flight distance was determined by actually hitting the ball by means of a swing robot (True Temper Co.) with a driver at a head speed (HS) of 45 m/s and with an iron at a head speed of 35 m/s.

Green stoppage

The ball was hit by means of the swing robot with a pitching wedge at a head speed of 35 m/s such that the ball might directly land on the green. The run was expressed by the distance between the landing position and the stop position. A negative value indicates that the ball rolled back due to the back spin, and a positive value indicates the distance that the ball rolled forward in the flight direction.

Hitting feel

Players with a head speed of 35 m/s actually hit the balls to judge whether the balls were felt soft or hard. The hard/soft feel was rated "◎" for a very soft feel, "O" for a soft feel, and "X" for a hard feel.

We claim:

1. A solid golf ball comprising; a solid core and a cover enclosing the core and having a multiplicity of dimples in its surface, wherein the core undergoes a distortion in the range of 2.8 to 4.0 mm under a load of 100 kg, the distortion (mm) of the core under a load of 100 kg divided by the distortion (mm) of the ball under a load of 100 kg is in the range of 1.0 to 1.3, the cover has a gage in the range of 1.4 to 1.9 mm and a Shore D hardness of 53 to 60, the dimples are of at least three type shaving different diameters, the diameter (mm) divided by the depth (mm) of each dimple is from 18 to 27, the volume of a dimple divided by the volume of a cylinder whose diameter and height correspond to the diameter and depth of the dimple, $V_0$ respectively, is from 0.390 to 0.550, the dimples having the largest diameter have a diameter of 3.6 to 4.5 mm and the dimples having the smallest diameter have a diameter of 2.0 to 3.8 mm and the total number of dimples is in the range of 390 to 450.

2. The solid golf ball of claim 1 wherein those dimples having the largest diameter account for at least 10% of the entire dimples, and the ratio of the diameter (mm) to the depth (mm) of said dimples having the largest diameter is from 22/1 to 26/1.

3. The solid golf ball of claim 1, wherein said core has a distortion in the range of 3.0 to 4.0 mm under a load of 100 kg.

4. The solid golf ball of claim 1, wherein said cover has a thickness in the range of 1.4 to 1.8 mm.

5. The solid golf ball of claim 1, wherein said solid core has a diameter in the range of 38.85 to 39.95 mm.

6. The solid golf ball of claim 1, wherein said dimples comprise 3 to 5 different types.

TABLE 4

| | | E1 | E2 | E3 | E4 | E5 | CE1 | CE2 | CE3 | CE4 | CE5 |
|---|---|---|---|---|---|---|---|---|---|---|---|
| Core distortion (mm) | | 2.95 | 3.30 | 3.60 | 3.90 | 3.95 | 2.60 | 3.00 | 2.90 | 3.00 | 4.00 |
| Ball distortion (mm) | | 2.72 | 3.07 | 3.08 | 3.68 | 3.40 | 2.35 | 2.65 | 2.08 | 2.50 | 3.50 |
| Core/ball distortion ratio | | 1.08 | 1.07 | 1.17 | 1.06 | 1.16 | 1.11 | 1.13 | 1.39 | 1.20 | 1.14 |
| Cover gage (mm) | | 1.5 | 1.5 | 1.8 | 1.5 | 1.9 | 2 | 1.4 | 2.4 | 1.9 | 1.8 |
| Cover resin | | I | I | II | I | II | II | III | IV | IV | III |
| Core hardness | | 56 | 56 | 57 | 56 | 57 | 57 | 60 | 65 | 65 | 60 |
| Dimple arrangement | | A | A | B | B | A | C | C | B | B | C |
| Feel (HS35) | | ○ | ◎ | ◎ | ◎ | ◎ | X | ○ | ○ | ○ | ◎ |
| Flight distance (m) | HS45 | 234 | 236.5 | 236 | 236 | 235.5 | 228 | 228.5 | 235 | 231 | 232.5 |
| | HS35 | 159 | 159.5 | 160 | 162 | 161 | 147.5 | 151.5 | 157.5 | 158 | 157 |
| Run or green stoppage (m) | | −0.5 | 0 | 0 | 0 | 0.5 | 0 | 1.5 | 2.5 | 3 | 1.5 |

Although some preferred embodiments have been described, many modifications and variations may be made thereto in the light of the above teachings. It is therefore to be understood that within the scope of the appended claims, the invention may be practiced otherwise than as specifically described.

7. The solid golf ball of claim 1, wherein said dimples have a diameter in the range of 3.0 to 4.3 m and a depth in the range of 0.09 to 0.25 mm.

8. The solid golf ball of claim 1, wherein $V_0$ is in the range of 0.395 to 0.545.

* * * * *